US008696532B1

(12) United States Patent
Peterson

(10) Patent No.: US 8,696,532 B1
(45) Date of Patent: Apr. 15, 2014

(54) EXERCISE BALL STABILIZER

(76) Inventor: Michael L. Peterson, Chestermere (CA)

( * ) Notice: Subject to any disclaimer, the term of this patent is extended or adjusted under 35 U.S.C. 154(b) by 434 days.

(21) Appl. No.: 13/163,127

(22) Filed: Jun. 17, 2011

(51) Int. Cl.
*A63B 26/00* (2006.01)
*A63B 21/00* (2006.01)

(52) U.S. Cl.
USPC ..... 482/142; 482/131

(58) Field of Classification Search
USPC ..... 482/23, 51, 77, 79, 91–96, 111–112, 482/121–123, 129–132, 139–142, 145
See application file for complete search history.

(56) References Cited

U.S. PATENT DOCUMENTS 5,810,700 A 9/1998 Orcutt
5,833,587 A 11/1998 Strong et al.
6,375,601 B1 4/2002 Johnson
6,461,284 B1 * 10/2002 Francavilla ..... 482/142
D476,705 S * 7/2003 Dillard ..... D21/662
6,689,026 B2 2/2004 Almada
6,746,372 B2 * 6/2004 Hsu ..... 482/34
7,060,015 B2 6/2006 Acher
7,118,517 B1 10/2006 Hale
7,674,216 B1 3/2010 Bolling

* cited by examiner

*Primary Examiner* — Oren Ginsberg
(74) *Attorney, Agent, or Firm* — Robert C. Montgomery; Montgomery Patent & Design

(57) ABSTRACT

An exercise ball stabilizer apparatus includes a ball stabilizing assembly and a telescopically connected platform assembly to allow for length adjustment along an axial distance between the stabilizer assembly and the platform assembly. The stabilizer assembly is adjustable to accommodate different exercise ball diameters. The exercise ball is stably maintained within the stabilizer assembly, thereby providing a stable support during conventional exercise ball exercising activities.

14 Claims, 3 Drawing Sheets

EXERCISE BALL STABILIZER

RELATED APPLICATIONS

The present invention was first described in a notarized Official Record of Invention on Aug. 4, 2010, that is on file at the offices of Montgomery Patent and Design, LLC, the entire disclosures of which are incorporated herein by reference.

FIELD OF THE INVENTION

The present invention relates generally to exercise equipment, and in particular, to a stabilizing base for retaining an resilient exercise ball in a stationary position and an adjustable foot platform to provide leverage to a user performing exercises on the exercise ball.

BACKGROUND OF THE INVENTION

Physical fitness and health concerns are among the areas of highest concern for people around the world. More than ever, people are frequenting health clubs and performing exercise routines at home in order to lose weight, improve muscle tone, and maintain a healthy lifestyle. One (1) popular exercise device found at many homes and gyms is that of the exercise ball. It is commonly used to strengthen core body muscles such as the abdominal muscles and back muscles. It does this by using the instability of the ball to force the user to engage additional core muscles to remain balanced. However, the round nature of the invention poses several problems.

The ball has a tendency to move about on the floor during use. This requires the user to brace it against an unmovable object such as a wall, which limits the exercise routines that can be performed and the range of motion of most exercises. Additionally, depending on the nature of the floor, it can be difficult to gain traction with one's feet during use. This forces the user to brace their feet against an unmovable object such as another exercise machine, a cabinet, a wall or the like.

There have been various attempts to provide exercise devices which are intended to be used with exercise balls to address one (1) or more of these problems. Typically, these devices also attempt to include ancillary exercise equipment. Examples of these devices can be seen by reference to several U.S. patents. U.S. Pat. No. 5,833,587, issued to Strong et al. discloses an apparatus and method for exercising having a base with a concave recess to receive the exercise ball and at least one attachment for an elastic exercise band.

U.S. Pat. No. 6,689,026, issued to Almada, discloses an abdominal exercise station intended to allow the user to perform sit-up type exercises having a frame assembly with footholds and handholds for stabilization while performing the exercises.

U.S. Pat. No. 7,674,216, issued to Bolling, discloses a fitness apparatus also having a base with a concave recess and attachable adjustable resistance training mechanisms for a variety of strength training exercises performed atop the exercise ball.

While these devices may achieve their purported objectives each suffer from one (1) or more disadvantage or deficiency related to design or utilization. Particularly, none of these devices provide for a convenient and adjustable way to stabilize the body of the exerciser while performing exercises on the exercise ball. Additionally, these devices limit the position of the body of the exerciser during the exercises.

SUMMARY OF THE INVENTION

The inventor has therefore recognized the aforementioned inherent problems and lack in the art and observed that there is a need for an apparatus by which usage of exercise balls can be accomplished without the disadvantages as described above and a method of performing exercises on the exercise ball. In accordance with the invention, it is an object of the present disclosure to solve at least one of these problems.

The inventor recognized these problems and has addressed this need by developing an exercise ball stabilizer that allows participants to perform physical workouts using an exercise ball in a manner which is quick, easy, and effective. The inventor has thus realized the advantages and benefits of providing the exercise ball stabilizing apparatus having a stabilizing base with a semi-spherical stabilizing recess for at least partially retaining a lower portion of the exercise ball in a stationary position. A platform is provided that is adjustably connected to the stabilizing assembly for supporting a user's feet when a user is in contact with an upper portion of the exercise ball. A stabilizer is also provided and is adjustably connected to the platform to retain the user's feet when the user is in contact with the upper end of the exercise ball.

In at least one embodiment, the stabilizing base includes at least two (2) adjusting jaws slidably coupled along a radius of the stabilizing recess, such that each adjusting jaw is selectably adjustable to engage the lower portion of the exercise ball and adjusts the inner diameter of the recess to accept exercise balls of varying diameters.

In at least one embodiment, the exercise ball stabilizing apparatus includes a stabilizing base having a semi-spherical recess and an outer extension member. An exercise ball having a lower portion at least partially retained in a stationary position within the recess. A platform having an inner extension member is adjustably connected to the outer extension member to adjust the position of the platform relative to the stabilizing base. The platform also includes a foot plank that is adjustably connected to the inner extension member for supporting a user's feet when a user is in contact with an upper portion of the exercise ball, said foot plank. A stabilizer is adjustably connected to the foot plank to retain the user's feet when the user is in contact with the upper end of the exercise ball and the bottom of the user's feet are in contact with the foot plank.

Furthermore, in at least one (1) embodiment a method of performing exercises on an exercise ball is provided by positioning an exercise ball atop of a stabilizing base having a semi-spherical recess for at least partially receiving a lower end of the exercise ball. The user slidingly adjusts each of a pair of jaws about a radius of the recess such that the engaged diameter of the recess supports the lower end of the exercise ball. The user mounts a portion of a body on an upper end of the exercise ball and performs various exercises upon the exercise ball.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
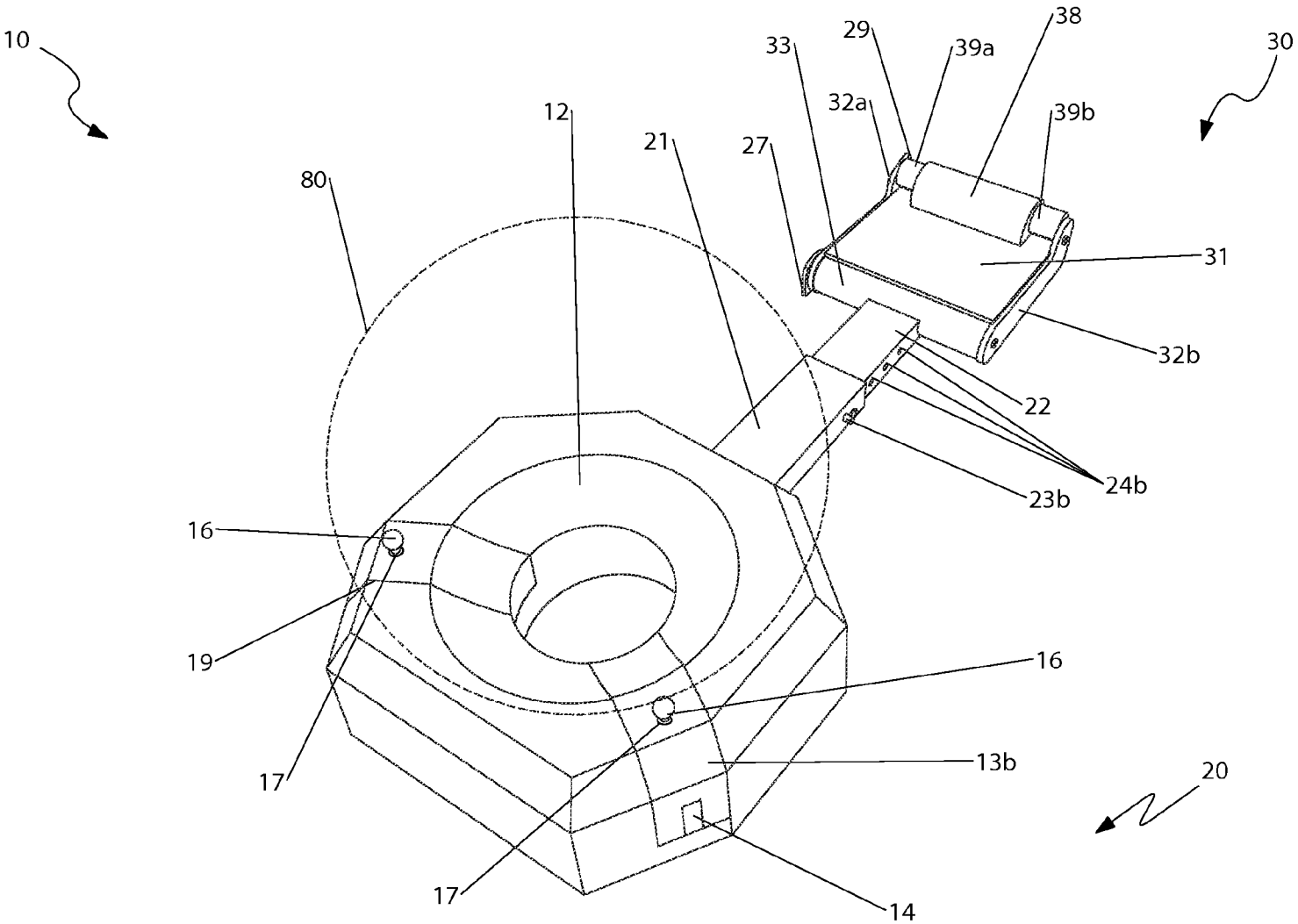
FIG. 1 is a perspective view of an exercise ball stabilizer, according to a preferred embodiment in accordance with the invention.

10 exercise ball stabilizer
11 stabilizing base
12 stabilizing recess
13*a* first jaw
13*b* second jaw
14 keyway
15 key
16 jaw pin
17 jaw aperture
18 key aperture
19 slot
20 stabilizing assembly
21 outer extension member
22 inner extension member
23*a* extension aperture
23*b* extension aperture
24*a* extension adjusting aperture
24*b* extension adjusting aperture
25 extension pin
26 tab
27 arm adjusting plate
29 stabilizer adjusting plate
30 platform assembly
31 platform
32*a* first arm
32*b* second arm
33 cross member
34 arm adjusting aperture
35 arm pin
36 stabilizer adjusting aperture
37 adjusting lever
38 stabilizer
39*a* first extension
39*b* second extension
40 arm aperture
80 exercise ball
81 floor

DETAILED DESCRIPTION OF THE PREFERRED EMBODIMENT

Figure 2:
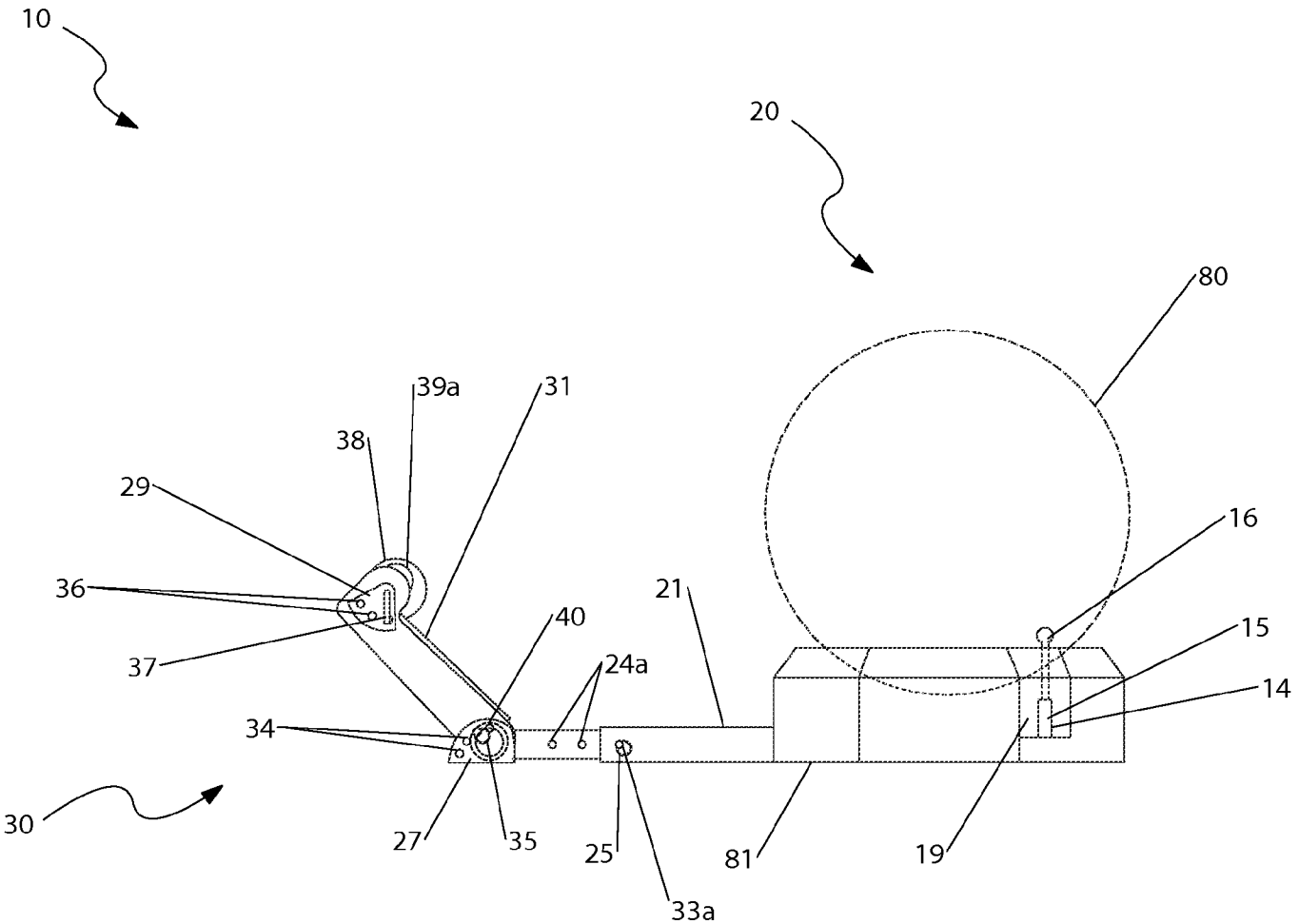
FIG. 2 is an orthographic side view of the exercise ball stabilizer according to the preferred embodiment.
Figure 3:
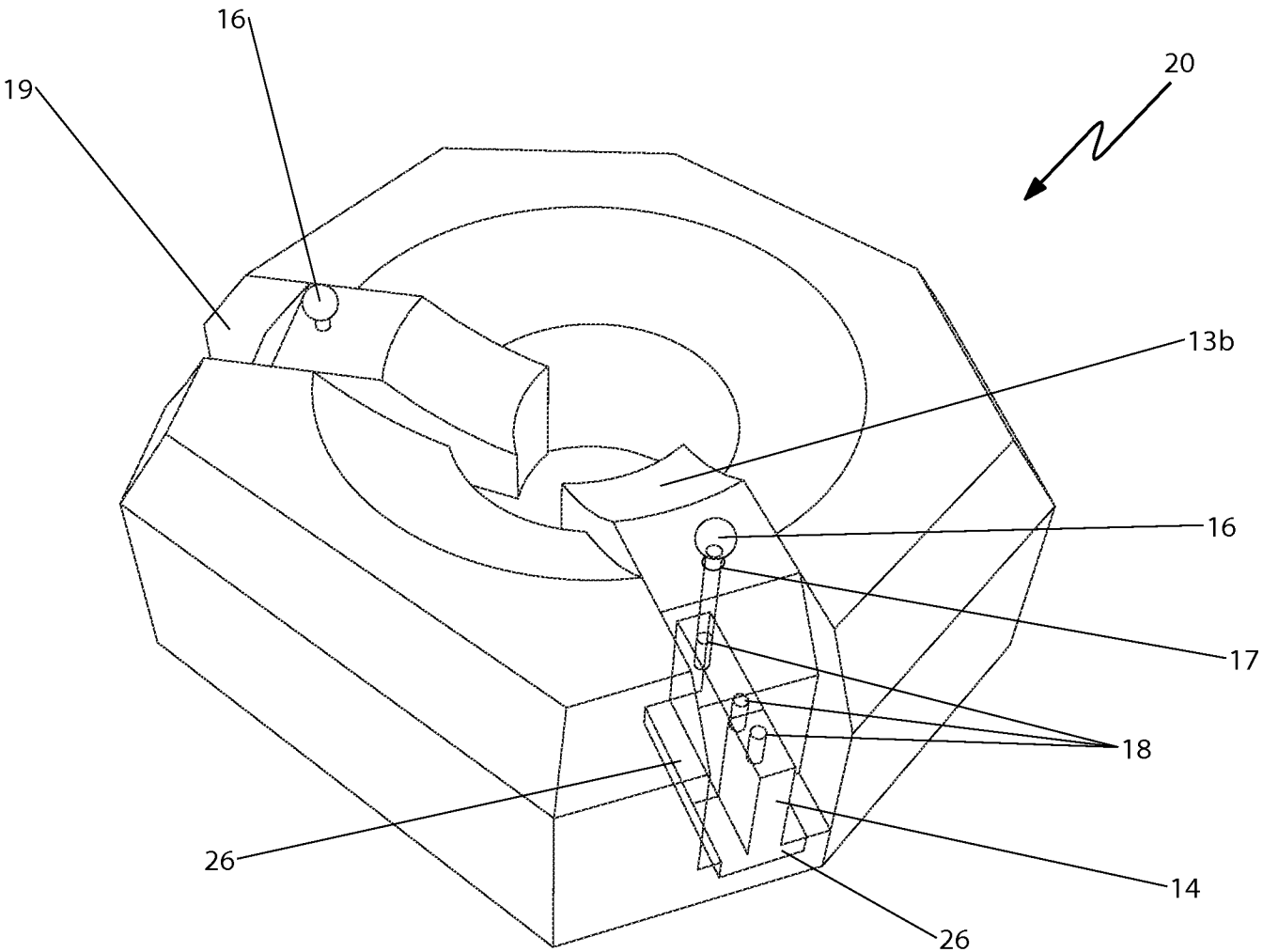
FIG. 3 is a perspective transparent view of the exercise ball stabilizer depicting a pair of adjusting jaws in a forwardly adjusted position, according to the preferred embodiment.

In accordance with the invention, the best mode is presented in terms of a preferred embodiment, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 3, depicting an exercise ball stabilizer (herein described as an "apparatus") 10, where like reference numerals represent similar or like parts. In accordance with the invention, the present disclosure describes the apparatus 10 which provides a stability platform for preventing an exercise ball 80 from rolling away from a user in the course of specialized exercises.

FIG. 1 shows a perspective view of the apparatus 10. The apparatus 10 includes a stabilizing assembly 20 to prevent the exercise ball 80 from rolling away from under a user while exercising. Additionally, the apparatus 10 includes a platform assembly 30 to stabilize the feet of the user while performing various exercises on the ball 80. The stabilizing assembly 20 includes a stabilizing base 11, a semi-spherical stabilizing recess 12, and a pair of radial slots 19 to slidingly contain a first jaw 13*a* and a second jaw 13*b*.

Since a perimeter of an inelastic ring configuration cannot be altered without deformation, the radially moveable pair of jaws 13*a*, 13*b*, in conjunction with an opposing side wall of the stabilizing recess 12 provides for adjustability to support exercise balls 80 having varying smaller diameters. The jaws 13*a*, 13*b* are slidably adjustable to configure the stabilizing recess 12 into three (3) equally spaced contact areas. An interior portion of each jaw 13*a*, 13*b* includes a radial keyway 14 slidingly enclosing a key 15. The key 15 forms an inverted narrow rectangular U-shape and is integral to a bottom portion of the slot 19. A jaw aperture 17 is disposed within an upper portion of each jaw 13*a*, 13*b*. A series of key apertures 18 is disposed within the top portion of the key 15. A jaw pin 16 is insertable through the jaw aperture 17 when aligned to a preselected one of the key apertures 18 to secure each jaw 13*a*, 13*b* to the adjusted position. This secures the exercise ball 80 within the recess 12.

The tray assembly 20 and the jaws 13*a*, 13*b* include a core made of materials such as: mild steel, aluminum or fiber composite and having exposed portions of the core covered by chemically bonded cushioning members, including a foam interior and a plastic covering.

FIG. 2 shows an orthographic side view of the apparatus 10. The apparatus 10 includes an axial outer extension member 21, envisioned as an integral member of the stabilizing base 11 of the stabilizing assembly 20, and an inner extension member 22 which provides for length adjustment between the stabilizing assembly 20 and the platform assembly 30. This adjustment is secured by inserting a first of a pair of extension pins 25 through an extension aperture 23*a* within a first side of the outer extension member 21 and a corresponding opposing extension adjusting aperture 24*a* selected from a series of extension adjusting apertures 24*a* disposed within a first side of the inner extension member 22. Another extension pin 25 is likewise inserted through an opposing extension aperture 23*b* within a second side of the outer extension member 21 and through a corresponding extension adjusting aperture 24*b* selected from a series of extension adjusting apertures 24*a* disposed within a second side of the inner extension member 22.

The angle of the platform assembly 30 is adjusted by removing an arm pin 35 from within a selected arm adjusting aperture 34 of a plurality included within an arm adjusting plate 27 and manually rotating a foot plank affixed between and opposing first arm 32*a* and second arm 32*b* about an axis defined by a cross member 33 in a clockwise or counterclockwise direction until a selected arm adjusting aperture 34 is aligned with an arm aperture 40 included within a lower portion of a first arm 32*a*. The arm pin 35 is reinserted into the aligned location and secures the angle of the platform assembly 30 relative to the inner extension member 22. The platform assembly 30 also includes a platform 31 permanently fastened between the first arm 32*a* and the second arm 32*b*, the tubular cross member 33, and a stabilizer adjusting plate 29. Additionally, the platform assembly 30 includes a concentric stabilizer 38 having a first eccentric extension 39*a* and a second eccentric extension 39*b* extending between the arms 32*a*, 32*b*.

The concentric stabilizer 38 stabilizes the user's feet, toes, or heels against the durable platform 31 while performing a variety of exercises. Rotating an adjusting lever 37 in a clockwise or counterclockwise direction reduces or increases a space between an upper portion of the platform 31 and the stabilizer 38. The stabilizer 38 is preferably a padded tubular member surrounding a cylindrical core where the first extension 39*a* and the second extension 39*b* are the ends of the core and are rotatably connected between the upper ends of the arms 32*a*, 32*b*. The adjusting lever 37 is rigidly affixed to the extension 39*a* such that rotation of the lever 37 correspondingly rotates the core between the arms 32*a*, 32*b*. The first extension 39*a* and the second extension 39*b* are located eccentrically through the stabilizer 38 such that rotation of the lever 37 adjusts the space between the platform 31 and the stabilizer 38. This adjustment allows for the foot to interface with the platform 31 and the stabilizer 38 depending upon the type of exercise being performed. For instance, when the user is performing exercises supported by the ball 80 in the supine position, the stabilizer is rotated such that sufficient space is provided to retain the toes and forward portion of the foot the user between the platform 31 and the stabilizer 38. When the user is in the prone position upon the ball 80 the heels of the foot are in contact with the stabilizer 38. When the user is in the side stabilized position, the outer side of the upwardly facing foot is in contact with the stabilizer 38. The portion of the adjusting lever facing a stabilizer adjusting plate 29 includes a detent intended to lock into any of a plurality of stabilizer adjusting apertures 36, thereby securing this adjustment and locking the rotatable position of the stabilizer 38 about the stabilizer adjusting plate 29.

FIG. 3 shows a perspective transparent view of the second jaw 13*b* of the apparatus 10. The first jaw 13*a* and the second jaw 13*b* each include the keyway 14 which slidingly encloses the key 15. The lower portion of each leg of the key 15 includes a pair of tabs 26 intended to form an integral connection onto the bottom portion of each slot 19, while the upper surface portion of the key 15 includes the plurality of key apertures 18.

It is envisioned that plastic members of the apparatus 10 are permanently fastened together by processes such as chemical bonding, welding, stitching, or heat sealing, and that metal members are permanently fastened together by processes such as welding, riveting or bolting, and that exposed steel members, such as the outer extension member 21, a welded assembly including the inner extension member 22 and the tubular cross member 33, the adjusting plates 27, 29, the arms 32*a* and 32*b*, are chrome or nickel plated, in the customary manner of state-of-the art exercise apparatus.

It is further envisioned that other styles and configurations of the present invention can be easily incorporated into the teachings of the present invention, and only one particular configuration shall be shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIG. 1.

The method of utilizing the apparatus 10 can be achieved by performing the following steps: checking the functioning and locking of all adjustments; becoming familiar with the features of the apparatus 10; procuring an exercise ball 80; checking the diameter of the ball 80; performing any necessary adjustments to accommodate the diameter of the selected exercise ball 80 by removing the pair of first pins 16 to free the jaws 13*a*, 13*b*; moving the jaws 13*a*, 13*b* to the selected location; ensuring the alignment of the apertures 16, 18, at the selected location; reinserting the pair of jaw pins 16 to secure the adjustment of the jaws 16 at the selected location; checking the distance between the stabilizing assembly 20 and the platform assembly 30 for user-friendliness; adjusting, if and as necessary, by removing the pair of extension pins 25 to free the inner extension member 22; sliding the inner extension member 22 in the required direction; ascertaining the alignment between the apertures 23*a*, 24*a*, 23*b*, 24*b*; reinserting the pair of extension pins 25; checking the angle of the platform assembly 30 for user-friendliness; adjusting, if and as necessary, by removing the arm pin 35 to free the first arm 32*a*; using a first hand to hold and move the platform assembly 30 in the desired direction; using a second hand to reinsert the arm pin 35 after insuring the alignment of the aperture within the first arm 32*a* and a selected arm adjustment aperture 34 of the arm adjusting plate 27; checking the opening between the upper edge portion of the platform 31 and the stabilizer 38 for a user-friendly retention of the user's foot for the particular exercise position; adjusting as necessary by moving the adjusting lever 37 in the desired direction until its detent locks into a selected stabilizer adjusting aperture 36; performing a variety of desired exercises; after use, spraying a cleaning agent onto all plastic coverings of the apparatus 10; and, wiping the cleaning agent from all sprayed areas.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An exercise ball stabilizing apparatus comprising:

a stabilizing base having a semi-spherical stabilizing recess for at least partially retaining a lower portion of an exercise ball in a stationary position;

a platform adjustably connected to said stabilizing base for supporting a user's feet when a user is in contact with an upper portion of said exercise ball;

a stabilizer adjustably connected to said platform to retain said user's feet when said user is in contact with said upper portion of said exercise ball; and, said stabilizing base further comprises at least two adjusting jaws slidably coupled along a radius of said stabilizing recess such that each adjusting jaw is selectably adjustable to engage said lower portion of said exercise ball.

2. The apparatus of claim 1, wherein said stabilizing base further comprises an outwardly extending hollow outer extension member and wherein said platform further comprises an inner extension member insertably connected to said outer extension member.

3. The apparatus of claim 2, wherein said platform further comprises:

a cross member affixed to an end of said inner extension member;

a foot plank for contact with said user's feet;

a pair of arms affixed to opposing sides of said foot plank and rotatably coupled to said cross member such that said foot plank is rotatably adjustable relative to said cross member.

4. The apparatus of claim 3, wherein said stabilizer further comprises a central shaft surrounded by a cylindrical member, said shaft rotatably connected between opposing upper ends of said pair of arms such that said cylindrical member is positionably adjustable relative to said foot plank.

5. The apparatus of claim 4, wherein said stabilizing base further comprises a pair of slots extending from a perimeter of said stabilizing recess to an outer edge, each of said slots slidingly receives one of said adjusting jaws for insertion into said stabilizing recess.

6. The apparatus of claim 5, wherein said cross member further comprises at least one arm adjusting plate on an end thereof for securing said pair of arms and said foot plank at a selected arm position relative to said cross member.

7. The apparatus of claim 6, wherein said at least one arm further comprises a stabilizer adjusting plate disposed on an end opposite said arm adjusting plate for securing said stabilizer at a selected stabilizer position relative to said foot plank.

8. The apparatus of claim 7, wherein said inner extension member is provided with a plurality of extension adjusting apertures and wherein said outer extension member is provided with an extension pin configured to selectively engage any one of said plurality of extension adjusting apertures so as to retain said inner extension member within said outer extension member at a selected position relative to said stabilizer base, said position being selected in dependence on said extension adjusting aperture selected for engagement with said extension pin.

9. The apparatus of claim 8, wherein said central shaft is eccentrically positioned completely through said cylindrical member.

10. The apparatus of claim 8, wherein each of said slots further comprises a key protruding perpendicularly upward and wherein each of said adjusting jaws further comprises a keyway disposed longitudinally along a bottom surface to sliding engage over said key.

11. The apparatus of claim 10, wherein each said key is provided with a plurality of key apertures and wherein each said jaw is provided with a jaw pin configured to selectively engage any one of said plurality of key apertures so as to retain said jaw within said slot at a selected location relative to said stabilizer recess, said location being selected in dependence on said key aperture selected for engagement with said jaw pin.

12. The apparatus of claim 8, wherein said arm adjusting plate is provided with a plurality of arm adjusting apertures and wherein said arm adjacent to said arm adjusting plate is provided with an arm pin configured to selectively engage with any one of said plurality of arm adjusting apertures so as to retain said foot plank at said selected arm position relative to said cross member, said arm position being selected in dependence on said arm adjusting aperture selected for engagement with said arm pin.

13. The apparatus of claim 8, wherein said stabilizer adjusting plate is provided with a plurality of stabilizer adjusting apertures and wherein said arm adjacent to said stabilizer adjusting plate is provided with a stabilizer pin configured to selectively engage with any one of said plurality of stabilizer adjusting apertures so as to retain said stabilizer at said selected stabilizer position relative to said foot plank, said stabilizer position being selected in dependence on said stabilizer adjusting aperture selected for engagement with said stabilizer pin.

14. An exercise ball stabilizing apparatus comprising:

a stabilizing base having a semi-spherical recess and an outer extension member;

an exercise ball having a lower portion at least partially retained in a stationary position within said recess;

a platform having an inner extension member adjustably connected to said outer extension member and a foot plank adjustably connected to said inner extension member for supporting a user's feet when a user is in contact with an upper portion of said exercise ball, said foot plank;

a stabilizer adjustably connected to said foot plank to retain said user's feet when said user is in contact with said upper portion of said exercise ball and said user's feet are in contact with said foot plank; and, said stabilizing base further comprises at least two adjusting jaws slidably coupled along a radius of said stabilizing recess such that each adjusting jaw is selectably adjustable to engage said lower portion of said exercise ball.

* * * * *